US008628063B1

(12) United States Patent
Stone

(10) Patent No.: US 8,628,063 B1
(45) Date of Patent: Jan. 14, 2014

(54) TOOL FOR SNAPPING AND THEN EXTRACTING A LOOP PANEL TIE FROM A WORKPIECE

(76) Inventor: Marc L. Stone, Commerical Point, OH (US)

( * ) Notice: Subject to any disclaimer, the term of this patent is extended or adjusted under 35 U.S.C. 154(b) by 59 days.

(21) Appl. No.: 12/807,764

(22) Filed: Sep. 14, 2010

(51) Int. Cl.
*E04G 17/06* (2006.01)

(52) U.S. Cl.
USPC ..... 254/131; 140/123

(58) Field of Classification Search
USPC ..... 254/120, 25, 27, 131, 240, 219, 235, 254/239, 255, 272, 278, 283.5; 140/102.5, 140/123, 149, 117, 118, 119; 245/134.3 FT, 245/134.3 R
See application file for complete search history.

(56) References Cited

U.S. PATENT DOCUMENTS 632,324 A * 9/1899 Pottenger ..... 140/117
694,768 A * 3/1902 Martin ..... 140/117
815,754 A * 3/1906 Smith ..... 140/117
1,045,679 A * 11/1912 Cronin ..... 254/134.3 PA
1,398,342 A * 11/1921 Pleaue ..... 30/164.5
1,415,693 A * 5/1922 Pederson ..... 254/131
1,530,455 A * 3/1925 Wright ..... 140/102.5
1,716,872 A * 6/1929 Williams ..... 425/111
2,195,773 A * 4/1940 Foshee ..... 140/117
2,491,582 A * 12/1949 Reid ..... 140/93 R
2,777,479 A * 1/1957 Beanum ..... 140/149
2,864,583 A * 12/1958 Bressler ..... 254/131
2,986,054 A * 5/1961 Lurie ..... 81/177.2
3,473,578 A 10/1969 McArdle et al.
3,546,919 A * 12/1970 Fial ..... 72/458
3,722,555 A * 3/1973 Voelsch ..... 140/123
3,724,060 A * 4/1973 McElroy ..... 29/426.2
3,873,068 A * 3/1975 Allen ..... 254/131
4,691,599 A * 9/1987 Schultz ..... 81/177.2
5,046,143 A * 9/1991 Uher ..... 200/331
5,193,378 A 3/1993 Ritter et al.
5,203,382 A * 4/1993 Barnhart et al. ..... 140/123
5,344,201 A * 9/1994 Offin ..... 294/24
5,431,196 A 7/1995 Forrester et al.
5,605,181 A 2/1997 Vuong
5,752,860 A 5/1998 Greaves
5,947,166 A 9/1999 Doyle et al.
D416,566 S 11/1999 Perez
6,199,456 B1 * 3/2001 Hlady ..... 81/177.2
6,619,332 B2 * 9/2003 Prunty ..... 140/123
6,659,697 B1 * 12/2003 Guenther ..... 410/103
6,668,872 B1 * 12/2003 Williams et al. ..... 140/123
6,729,358 B1 * 5/2004 Moffatt ..... 140/118
6,997,030 B1 2/2006 Williams
7,195,041 B2 * 3/2007 Lile ..... 140/117
D567,042 S * 4/2008 Wilkes ..... D8/44
7,673,848 B1 * 3/2010 Provines ..... 254/25
2006/0065882 A1 * 3/2006 Picard ..... 254/131
2010/0077890 A1 * 4/2010 Neiser et al. ..... 81/3.09
2010/0127226 A1 * 5/2010 Smith ..... 254/27

OTHER PUBLICATIONS

"Concrete Form Tie and Accessory Wedge Bolt." Jun. 2, 2008. Traders City. Jun. 28, 2013. <http://www.traderscity.com/board/products-1/offers-to-sell-and-export-1/concrete-form-tie-and-accessory-wedge-bolt-21270/>.*

* cited by examiner

*Primary Examiner* — Lee D Wilson
*Assistant Examiner* — Joel Crandall
(74) *Attorney, Agent, or Firm* — Miracle IP; Bryce D. Miracle

(57) ABSTRACT

A tool for snapping and then extracting a loop panel tie from a workpiece which comprises a handle. A head extends at a right angle from the handle. A mechanism in the head is for snapping the loop panel tie in the workpiece. A mechanism on the handle at the head is for extracting the loop panel tie from the workpiece.

5 Claims, 4 Drawing Sheets

TOOL FOR SNAPPING AND THEN EXTRACTING A LOOP PANEL TIE FROM A WORKPIECE

BACKGROUND OF THE INVENTION

1. Field of the Invention

The present invention relates to a tie breaker tool, and more particularly, a tool for snapping and then extracting a loop panel tie from a workpiece.

2. Description of the Prior Art

Numerous innovations for various tools for manipulating wires and bars in concrete foundations have been provided in the prior art that will be described. Even though these innovations may be suitable for the specific individual purposes to which they address, however, they differ from the present invention.

A FIRST EXAMPLE, U.S. Pat. No. 3,473,578, Issued on Oct. 21, 1969, to McArdle et al. teaches a form tie breaker tool comprising aligned shank and blade portions suited for engagement with a form tie terminal loop protrusion on a cast wall surface, to transmit torsional forces applied to the shank for separation of the engaged protrusion from the wall, moderate structural variation of the blade portion of the tool accommodating adaptation of its operative principle to the removal of loop protrusions of diverse particularity. The tool blade, in one preferred form, is characterized by an arcuate slot engageable with the end of the loop and a laterally tapered nose insertable within a form tie supplement; in another form, the tool blade is characterized by a somewhat similar slot and an arcuate, generally wedge shaped, inner end.

A SECOND EXAMPLE, U.S. Pat. No. 5,193,378, Issued on Mar. 16, 1993, to Ritter et al. teaches an apparatus for bending rod-shaped material to form concrete-reinforcement elements, having a frame for supporting a material feed device and having a bearer for bending members, which bearer is mounted on the frame so as to be rotatable about the axis of feed, is adjustable relative to the frame and is constructed as a material supporting table which is adjustable in a predetermined angular position relative to the frame, on which material supporting table a cutting device is provided upstream of the bending members in the material feed direction for cutting off the rod-shaped material from the line of material after the bending operation.

A THIRD EXAMPLE, U.S. Pat. No. 5,431,196, Issued on Jul. 11, 1995, to Forrester et al. teaches a power tool for automatically tying intersecting rod-like members with wire, comprising a jaw assembly comprising a fixed jaw having an interior groove to receive wire, a moveable jaw having an interior groove to receive wire, the movable jaw being rotatable into a closed position abutting the fixed jaw, wire feed means for projecting wire through interior grooves for receiving wire prior to the wire entering the jaw assembly, the entrance groove guide being located between two tensioned blocks, an exit groove guide for receiving wire after the wire exits the jaw assembly, the exit groove guide being located between the tensioned blocks and oriented in such a manner so that the wire in such exit groove guide crosses the jaw assembly when the movable jaw is in the closed position, an entrance groove guide wire in such entrance groove guide, rotatable spindle means comprising a pair of cutter blades for cutting wire, wherein one of the cutter blades is rotatable, and means for twisting the ends of the wire after the wire has been cut, and motive means for operating the wire feed means and the spindle means.

A FOURTH EXAMPLE, U.S. Pat. No. 5,605,181, Issued on Feb. 25, 1997, to Vuong teaches a handheld wire twisting apparatus that can be readily applied to a working section of an elongated electrical harness to be twisted, operated to impart twist to the desired extent, then removed after the twist has been secured in the harness. It includes a housing with an integral handle. An internal cylindrical bearing surface defines a transverse axis and includes an inlet into a bearing cavity which is a hiatus in the bearing surface. A c-shaped cylindrical wire twisting head is journaled on the cylindrical bearing surface for rotation about the transverse axis and defines a transverse passageway for reception of a wire bundle to be twisted. The wire twisting head has a peripheral gap for reception of the wire bundle into the transverse passageway when the peripheral gap is coextensive with the inlet in the housing. A gear train is rotatably mounted between opposed plate members comprising the housing for rotating the head, selectively, in first and second directions about the transverse axis and a ratchet mechanism selectively preventing rotation of the head in the first and second directions. The wire twisting head includes a c-shaped cylindrical drive wheel, a c-shaped cylindrical socket member having a peripheral opening and adapted for releasable attachment to the drive wheel, and a diametrically extending wire engagement member fixed to the socket member and projecting toward the peripheral opening. Mutually engageable key means on the socket member and on the drive wheel releasably attaches the socket member to the drive wheel.

A FIFTH EXAMPLE, U.S. Pat. No. 5,752,860, Issued on May 19, 1998, to Greaves teaches a clamp for clamping two elongate members together, wherein one elongate member has substantially radial ridges, wherein the clamp includes a first clamp element having a first clamp surface; a second clamp element having a second clamp surface; and a member for securing the first clamp element to the second clamp element in a secured position with the first and second clamp surfaces facing each other, wherein the first and second clamp surfaces in the secured position define first and second channels for clamping two substantially elongate members, and wherein at least one channel of the first and second channels has a plurality of teeth spaced longitudinally along the channel and defining gaps therebetween.

A SIXTH EXAMPLE, U.S. Pat. No. 5,947,166, Issued on Sep. 7, 1999, to Doyle et al. teaches a wire tying tool having a set of movable talons for channeling a loop of hard wire around a rebar joint or other object(s) to be tied with a wire knot at high speed; a heavy duty wire drive with a pullback feature to retract the loop under tension to tighten the loop around the joint; a clutch-controlled retractable reel to hold the tension on the hard wire on the reel; a spinner/cutter that extrudes a knot by turning, kinking, and cutting the wire (holding the cut ends under tension) and then spinning in complete revolutions to twist the wire into a knot while drawing the spinner away from the work surface. In a preferred embodiment a single reversible motor powers each of a wire drive, a talon drive and a spinner drive; logic and control elements control a sequence of operations of the various drives.

A SEVENTH EXAMPLE, U.S. Pat. No. D416,566, Issued on Nov. 16, 1999, to Perez teaches an ornamental design for a tool for bending rebar, as shown and described.

AN EIGHTH EXAMPLE, U.S. Pat. No. 6,668,872, Issued on Dec. 30, 2003, to Williams et al. teaches form tie breaking tools which include first members, second members and third members. Each member includes a first end and a second end. In particular embodiments, the second member is attached to the first member at either of the second end or between first and second ends of the first member. The third member is attached to the remaining of the second end or between the first and second ends of the first member. Second and third members are attached to the first member approximately parallel to one another. Each third member first end has a form tie engaging member attached. Each form tie engaging member includes a first end and a second end and the form tie engaging member is substantially perpendicularly attached to the third member.

A NINTH EXAMPLE, U.S. Pat. No. 6,997,030, Issued on Feb. 14, 2006, to Williams teaches a bending tool for bending rebar, rod, pipe, tubing and/or any other suitable material, comprising: at least one base, and; at least one lever-handle further comprising a user-end and a pivot-end and; a pivotal means for connecting the base and the pivot-end of the lever-handle with rotational freedom, and; a means for bending disposed on the pivot-end of the lever-handle. Optionally, a pre-measure base and protractor or angle indicator may be also used. The lever-handle may be removed and used independently as a pry-bar to reposition protruding rebar from hardened concrete in the wrong location and for other prying-type uses.

It is apparent now that numerous innovations for various tools for manipulating wires and bars in concrete foundations have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a tool for snapping and then extracting a loop panel tie from a workpiece that avoids the disadvantages of the prior art.

ANOTHER OBJECT of the present invention is to provide a tool for snapping and then extracting a loop panel tie from a workpiece that is simple and inexpensive to manufacture.

STILL ANOTHER OBJECT of the present invention is to provide a tool for snapping and then extracting a loop panel tie from a workpiece that is simple to use.

BRIEFLY STATED, STILL YET ANOTHER OBJECT of the present invention is to provide a tool for snapping and then extracting a loop panel tie from a workpiece which comprises a handle. A head extends at a right angle from the handle. A mechanism in the head is for snapping the loop panel tie in the workpiece. A mechanism on the handle at the head is for extracting the loop panel tie from the workpiece.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

A MARSHALING OF REFERENCE NUMERALS UTILIZED IN THE DRAWING

Figure 1:
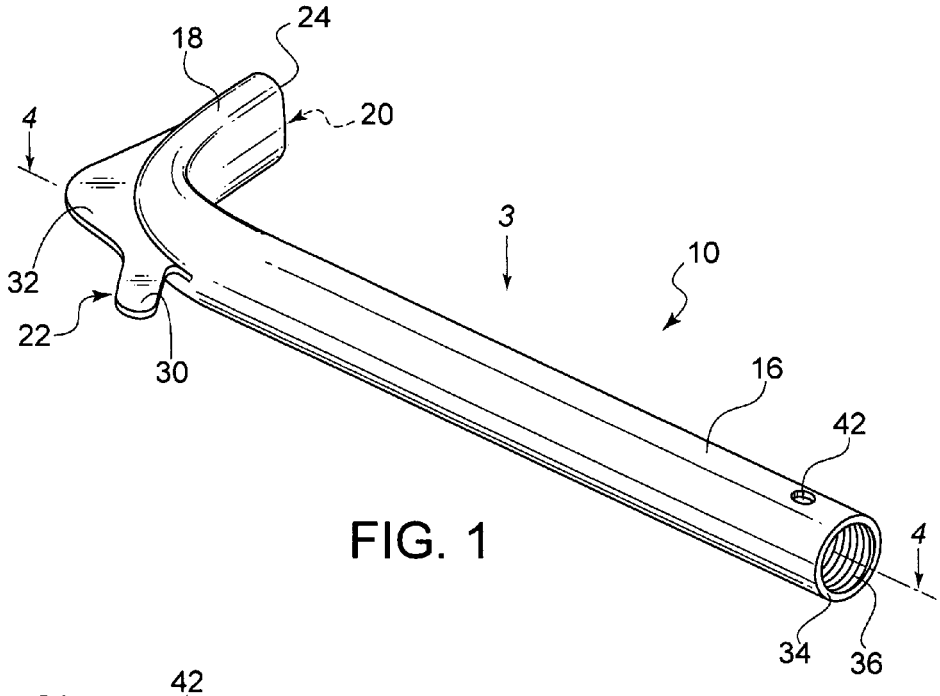
FIG. 1 is a diagrammatic perspective view of an embodiment of the present invention, as seen from the right bottom end thereof.
Figure 2:
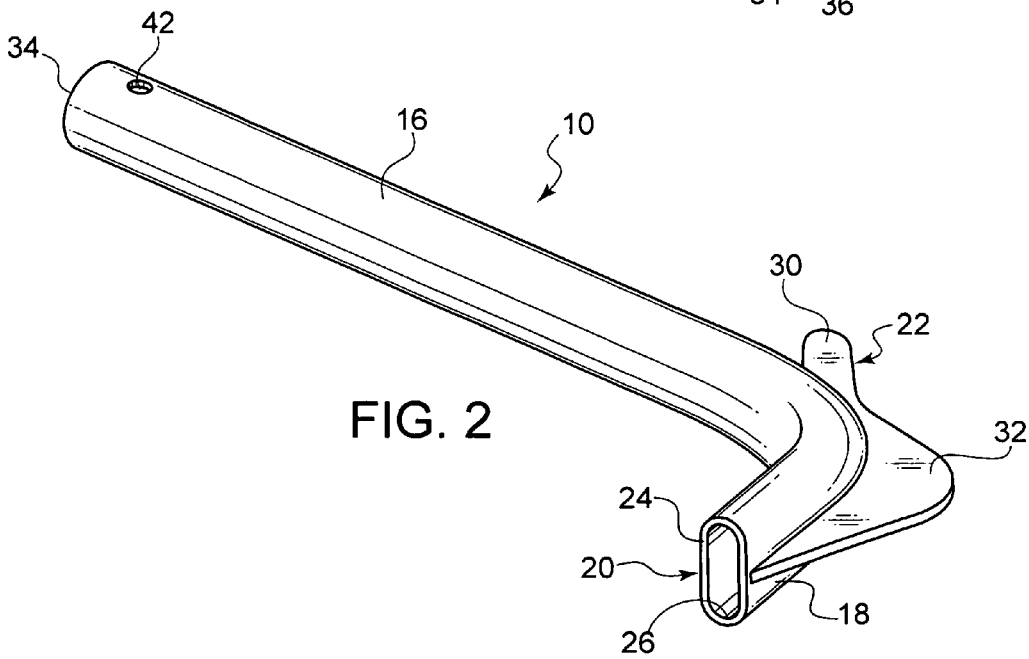
FIG. 2 is a diagrammatic perspective view of the present invention, as seen from the right top end thereof.
Figure 3:
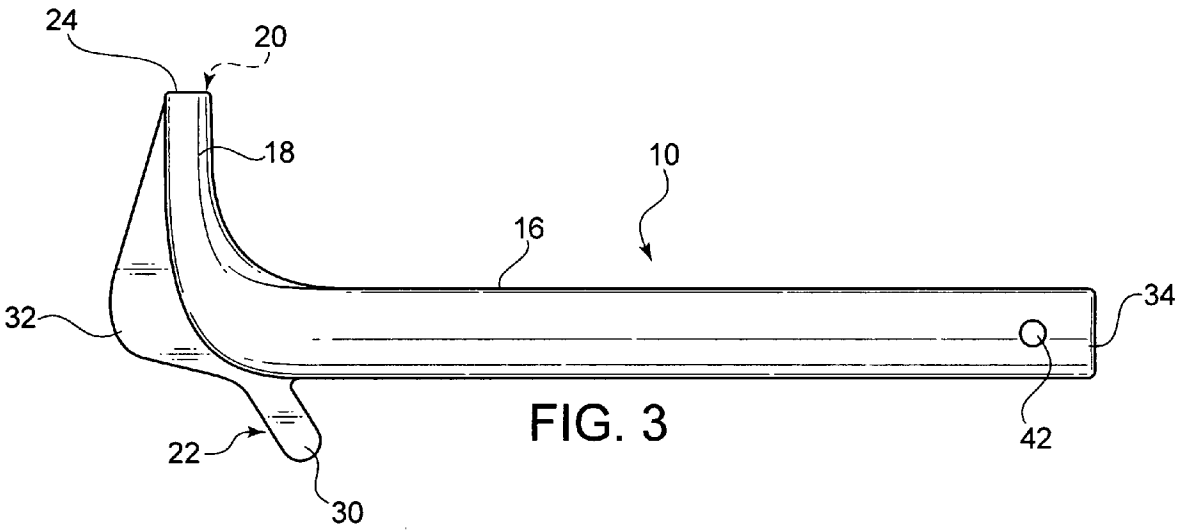
FIG. 3 is a diagrammatic right elevational view taken in the direction of arrow 3 in FIG. 1.
Figure 4:
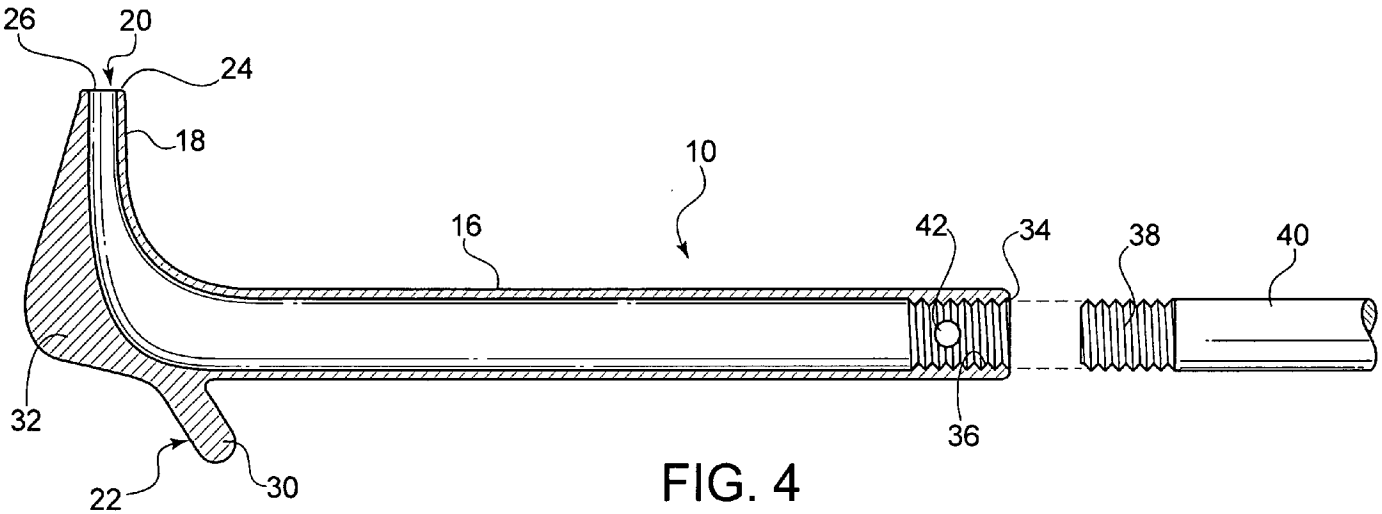
FIG. 4 is a diagrammatic cross sectional view taken on line 4-4 in FIG. 1.

10 tool
12 loop panel tie
14 workpiece
16 handle of tool 10
18 head of tool 10
20 snapping mechanism of tool 10
22 extracting mechanism of tool 10
24 free end of head 18
26 oval aperture of snapping mechanism 20
28 loop end of loop panel tie 12
30 flat finger of extracting mechanism 22
32 convex curved fin of tool 10
34 free end of handle 16
36 internally threaded bore in free end 34
38 externally threaded shank of extension handle 40
40 extension handle
42 aperture in handle 16

DETAILED DESCRIPTION OF THE PREFERRED EMBODIMENT

Figure 5:
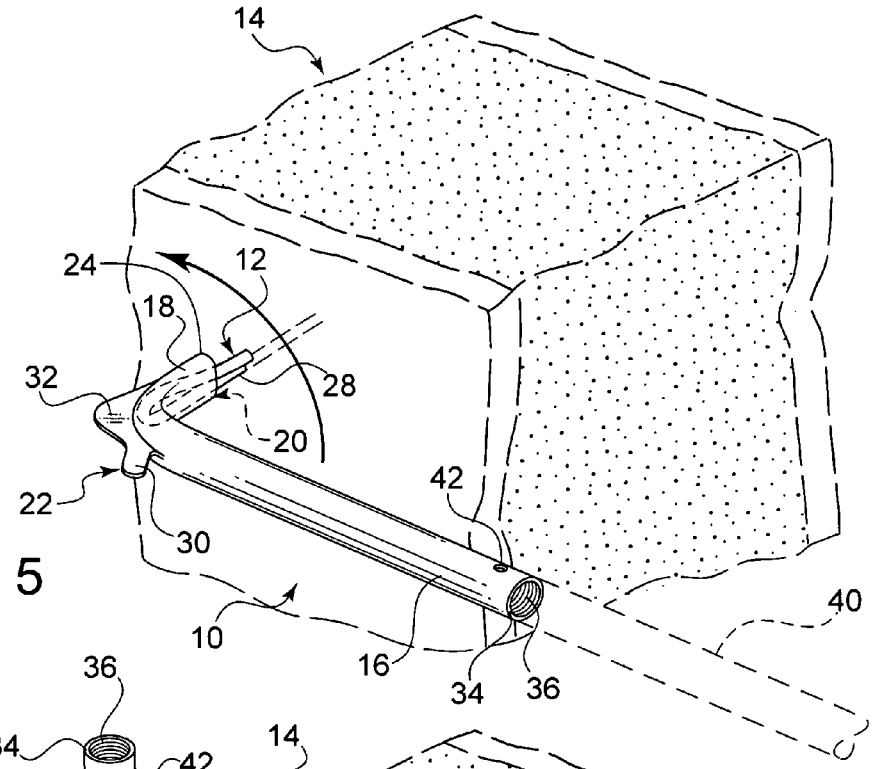
FIG. 5 is a diagrammatic perspective view, showing the oval aperture in the head of the present invention placed over a loop end of a loop panel tie in a workpiece.
Figure 6:
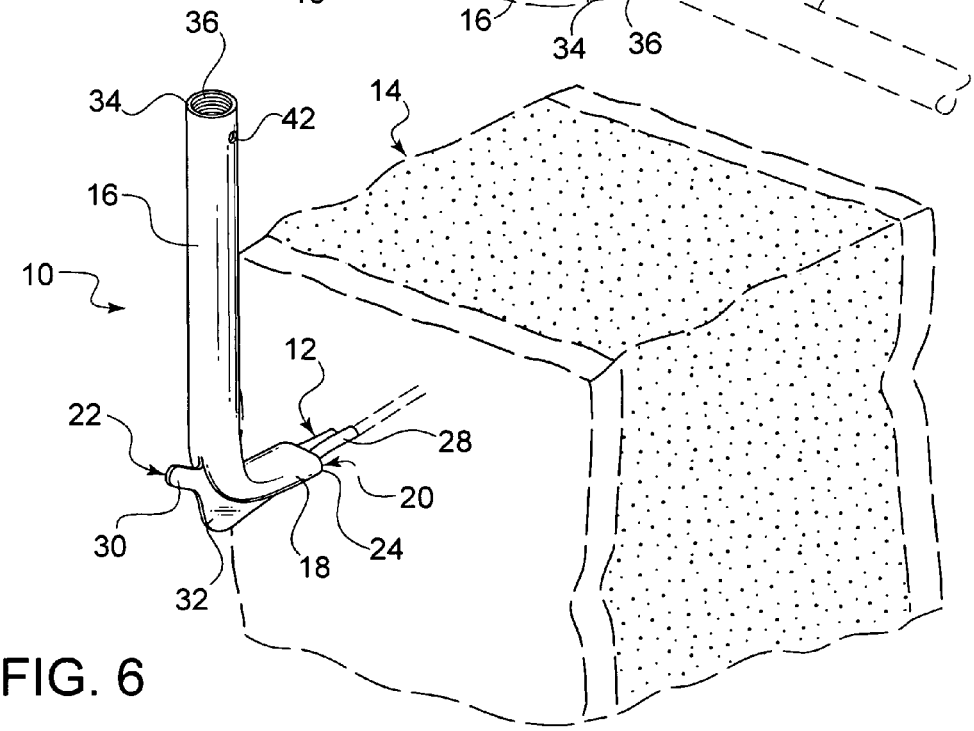
FIG. 6 is a diagrammatic perspective view similar to FIG. 5, showing the handle of the present invention manually rotated for snapping the loop end of the loop panel tie in the workpiece.
Figure 7:
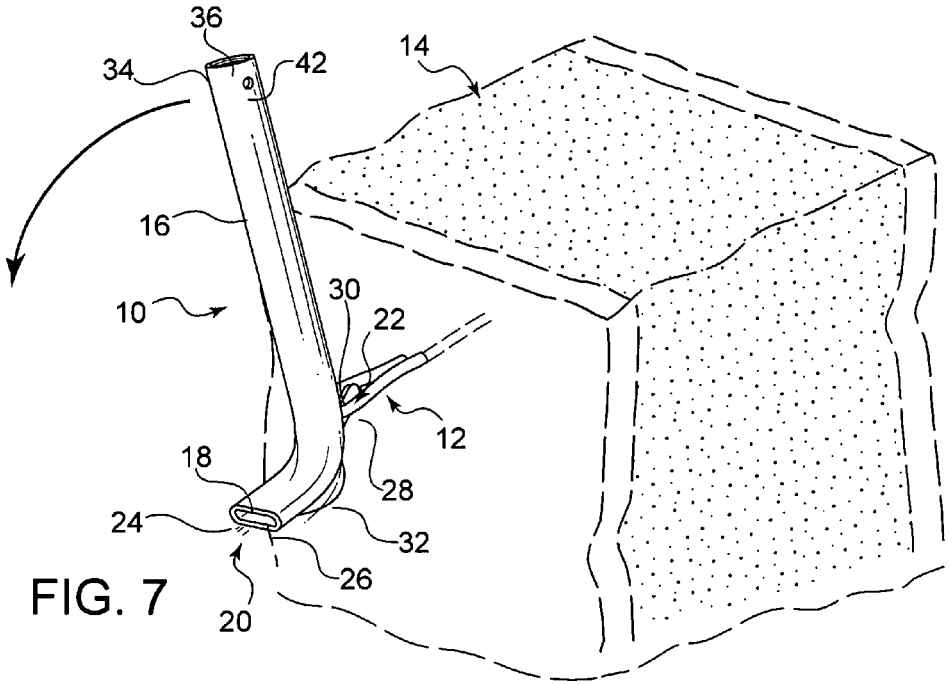
FIG. 7 is a diagrammatic perspective view similar to FIG. 6, showing the flat finger of the present invention inserted into the loop end of the loop panel tie to extract the loop end of the loop panel tie out of the workpiece.
Figure 8:
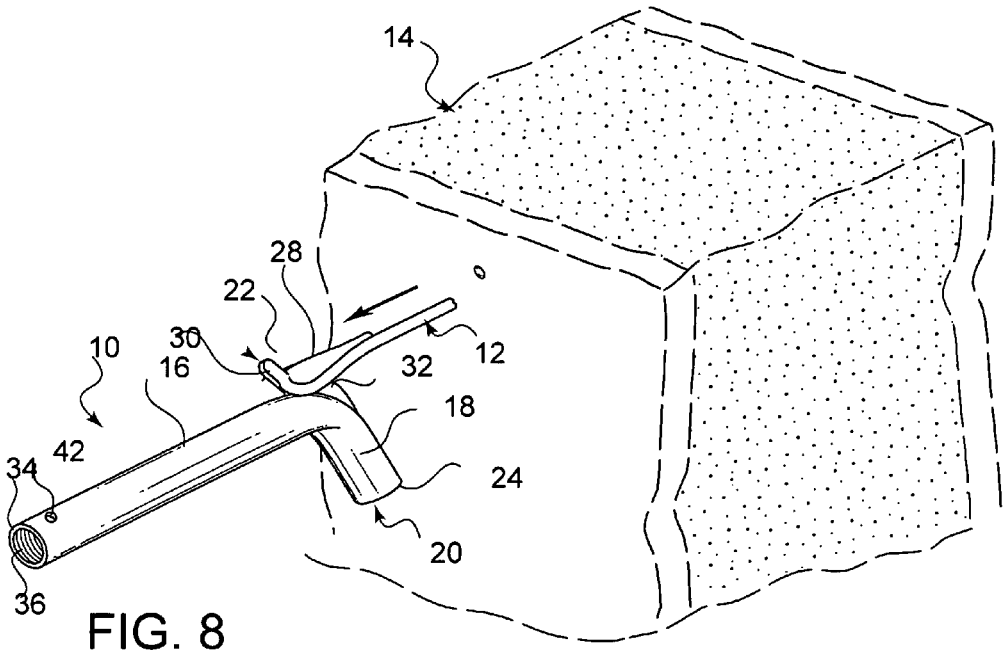
FIG. 8 is a diagrammatic perspective view similar to FIG. 7, showing the flat finger of the present invention fully extracting the loop end of the loop panel tie out of the workpiece.

Referring now to the figures, in which like numerals indicate like parts, and particularly to FIGS. 1 through 8, which are a diagrammatic perspective view of an embodiment of the present invention, as seen from the right bottom end thereof; a diagrammatic perspective view of the present invention, as seen from the right top end thereof; a diagrammatic right elevational view taken in the direction of arrow 3 in FIG. 1; a diagrammatic cross sectional view taken on line 4-4 in FIG. 1; a diagrammatic perspective view, showing the oval aperture in the head of the present invention placed over a loop end of a loop panel tie in a workpiece; a diagrammatic perspective view similar to FIG. 5, showing the handle of the present invention manually rotated for snapping the loop end of the loop panel tie in the workpiece; a diagrammatic perspective view similar to FIG. 6, showing the flat finger of the present invention inserted into the loop end of the loop panel tie to extract the loop end of the loop panel tie out of the workpiece; and a diagrammatic perspective view similar to FIG. 7, showing the flat finger of the present invention fully extracting the loop end of the loop panel tie out of the workpiece, and as such, will be discussed with reference thereto.

The present invention is a tool 10 for snapping and then extracting a loop panel tie 12 from a workpiece 14 which comprises a handle 16. A head 18 extends at a right angle from the handle 16. A mechanism 20 in the head 18 is for snapping the loop panel tie 12 in the workpiece 14. A mechanism 22 on the handle 16 at the head 18 is for extracting the loop panel tie 12 from the workpiece 14.

The snapping mechanism 20 comprises a free end 24 of the head 18 having an oval aperture 26 therein to receive and grip a loop end 28 of the loop panel tie 12 that extends out of the workpiece 14. When the handle 16 is manually rotated upwardly the loop end 28 of the loop panel tie 12 will become twisted and snapped off.

The extracting mechanism 22 comprises a flat finger 30 extending outwardly and angularly away from the juncture of the head 18 and the handle 16. When the flat finger 30 is inserted into the snapped off loop end 28 of the loop panel tie 12 and the handle 16 is manually pulled down away from the workpiece 14, the loop end 28 of the loop panel tie 12 will be extracted out of the workpiece 14 by the flat finger 30.

A flat convex curved fin 32 is integral with the flat finger 30 at the juncture of the head 18 and the handle 16 to reinforce connection of the head 18 with the handle 16 and to guide the handle 16 when the handle 16 is manually pulled down away from the workpiece 14.

The handle 16 comprises a free end 34 having an internally threaded bore 36 to receive an externally threaded shank 38 of an extension handle 40 to increase leverage of the handle 16. The free end 34 of the handle 16 has two oppositely positioned transverse apertures 42 to receive two setscrews (not shown) to retain the externally threaded shank 38 of the extension handle 40 within the internally threaded bore 36 of the handle 16.

The tool 10 can be fabricated out of a durable material, such as metal, plastic or wood. It can be made out of a hollow or solid bent tube. The workpiece 14 can be a poured concrete wall, foundation or other structure with panels on opposite sides and held together by the loop panel ties 12. The tool 10 is used to extract the loop ends 28 of the loop panel ties 12, so that the panels can be removed.

It will be understood that each of the elements described above, or two or more together, may also find a useful application in other types of constructions differing from the types described above.

While the invention has been illustrated and described as embodiments of a tool for snapping and then extracting a loop panel tie from a workpiece, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A tool for snapping and then extracting a loop panel tie from a workpiece which comprises:

a) a handle;

b) a head extending at a substantially right angle at a juncture from said handle;

c) a snapping mechanism at a free end of said head wherein said snapping mechanism comprises an oval aperture adapted to receive and grip a loop end of the loop panel tie that extends out of the workpiece, wherein when said handle is manually rotated the loop end of the loop panel tie will become twisted and snap off; and d) an extracting mechanism attached to the handle adjacent the juncture comprising a flat finger extending outwardly and angularly from the juncture towards the free end of the handle, wherein when said flat finger is inserted into the snapped off loop end of the loop panel tie and said handle is manually pulled away from the workpiece, the loop end of the loop panel tie will be extracted out of the workpiece by said finger.

2. The tool as recited in claim 1, further comprising a flat convex curved fin integral with said flat finger at the juncture of said head and said handle to reinforce connection of said head with said handle and to guide said handle when said handle is manually pulled down away from the workpiece.

3. The tool as recited in claim 2, wherein said handle comprises a free end having an internally threaded bore to receive an externally threaded shank of an extension handle to increase leverage of said handle.

4. The tool as recited in claim 3, wherein said free end of said handle having two oppositely positioned transverse apertures to receive two setscrews to retain the externally threaded shank of the extension handle within said internally threaded bore of said handle.

5. A tool for snapping and then extracting a loop panel tie from a workpiece which comprises:

a) a handle;

b) a head extending at a substantially right angle at a juncture from said handle;

c) a snapping mechanism at a free end of said head wherein said snapping mechanism comprises an oval aperture therein to receive and grip a loop end of the loop panel tie that extends out of the workpiece, wherein when said handle is manually rotated the loop end of the loop panel tie will become twisted and snap off;

d) an extracting mechanism on the handle near the juncture comprising a flat finger extending from the juncture outwardly and angularly towards the free end of the handle, wherein when said flat finger is inserted into the snapped off loop end of the loop panel tie and said handle is manually pulled down away from the workpiece, the loop end of the loop panel tie will be extracted out of the workpiece by said flat finger;

e) a flat convex curved fin integral with said flat finger at the juncture of said head and said handle to reinforce connection of said head with said handle and to guide said handle when said handle is manually pulled down away from the workpiece; and f) said handle further comprising a free end having an internally threaded bore to receive an externally threaded shank of an extension handle to increase leverage of said handle.

* * * * *